US005299331A

United States Patent [19]

Badillo

[11] Patent Number: 5,299,331

[45] Date of Patent: Apr. 5, 1994

[54] BEACH BLANKET ASSEMBLY WITH RAISED BORDER

[76] Inventor: Nilsa E. Badillo, 26 Winston Dr., Brentwood, N.Y. 11717

[21] Appl. No.: 985,315

[22] Filed: Dec. 4, 1992

[51] Int. Cl.[5] ..... A47G 9/06

[52] U.S. Cl. ..... 5/417; 5/922; 135/118

[58] Field of Search ..... 5/417–420, 5/922; 135/118; 52/DIG. 13

[56] References Cited

U.S. PATENT DOCUMENTS

| | | | |
|---|---|---|---|
| D. 270,133 | 8/1983 | Craig | D8/8 |
| 2,809,006 | 10/1957 | Dansey | 5/417 |
| 2,907,057 | 10/1959 | Specht | 5/417 |
| 2,939,468 | 6/1960 | Boyce | 5/417 |
| 3,241,202 | 3/1966 | Knauft | 5/417 |
| 3,935,653 | 2/1976 | Klein | 40/125 H |
| 4,137,584 | 2/1979 | Sharber | 5/417 |
| 4,703,528 | 11/1987 | Rolle | 5/417 |
| 4,709,430 | 12/1987 | Nicoll | 5/417 |
| 4,951,333 | 12/1987 | Kaiser et al. | 5/417 |
| 5,018,230 | 5/1991 | Steberger | 5/420 |
| 5,085,212 | 2/1992 | De Costa | 5/420 |

*Primary Examiner*—Alexander Grosz
*Attorney, Agent, or Firm*—Galgano & Belkin

[57] ABSTRACT

A beach blanket assembly includes a beach blanket, an inflatable beach bumper, and a multiplicity of stakes. The beach blanket has a central portion and a surrounding peripheral border wherein the peripheral border is held in a supported generally upright position by the stakes and the inflatable beach bumper. The stakes each have a lower end portion which is embedded in the beach surface and an upper end portion which abuts the inflatable beach bumper. The upper end portions are further releasably attached to the peripheral border of the beach blanket. A multiplicity of fastener type hook and loop material patches permits the peripheral border of the blanket to be releasably attachable to the inflatable bumper. An alternative embodiment of the present beach blanket assembly includes a beach blanket and a multiplicity of stakes which are shaped and configured to support the entire peripheral border of the beach blanket above the beach surface as well as securely anchor the beach blanket to the beach surface.

11 Claims, 3 Drawing Sheets

FIG. 1
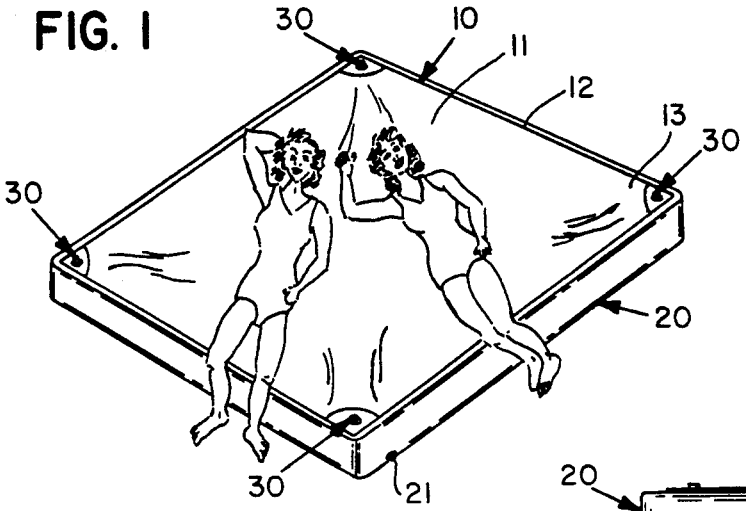
FIG. 2
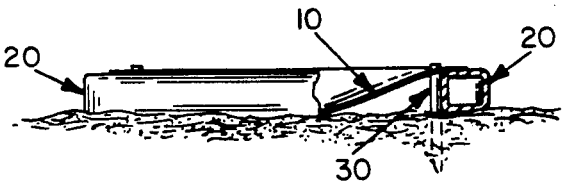
FIG. 3
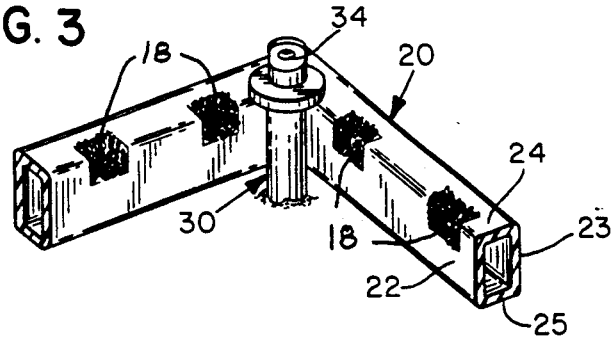
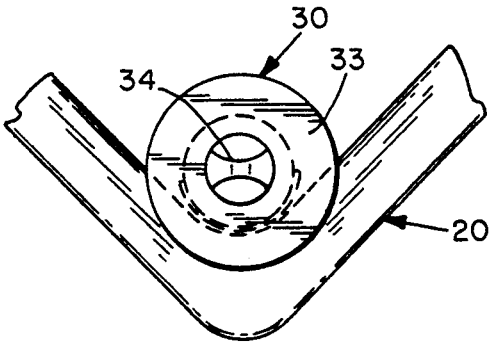
FIG. 4

FIG. 5
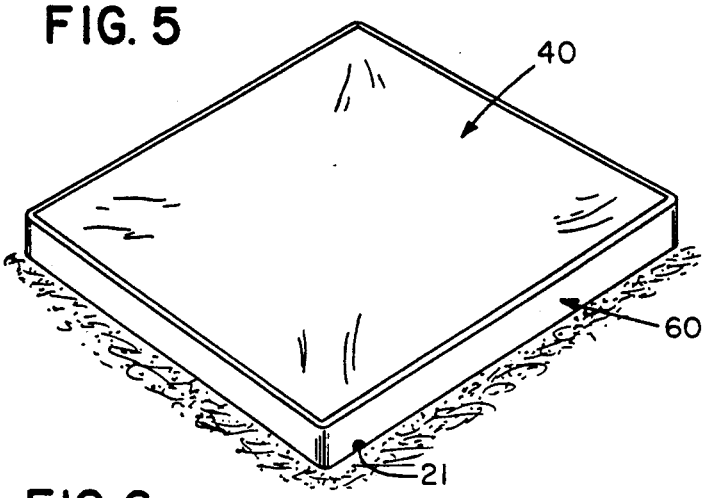
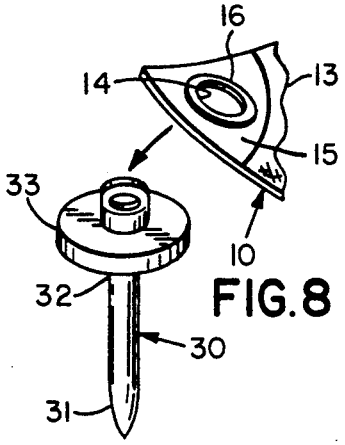
FIG. 8
FIG. 6
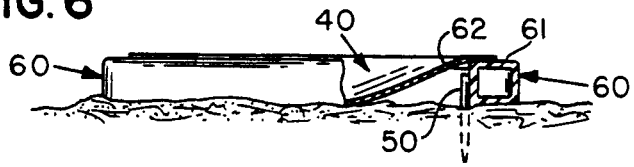
FIG. 9
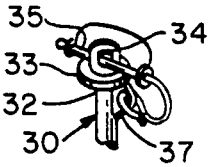
FIG. 7
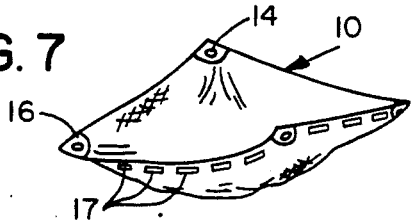
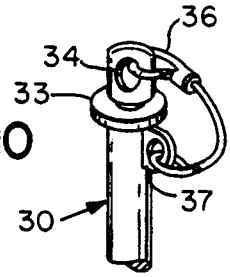
FIG. 10
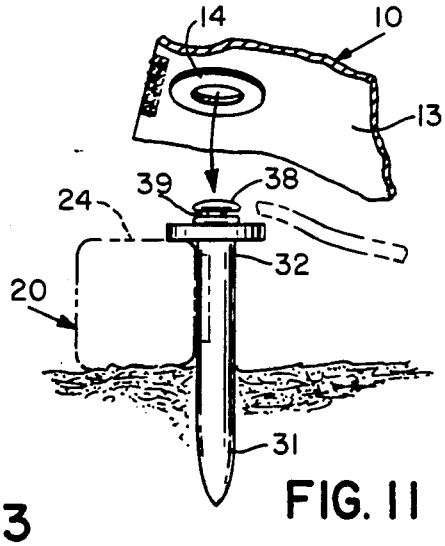
FIG. 11
FIG. 12
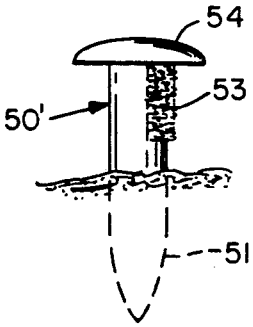
FIG. 13
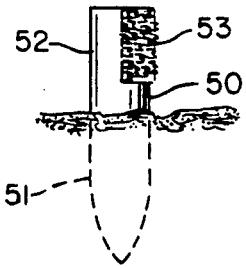

BEACH BLANKET ASSEMBLY WITH RAISED BORDER

BACKGROUND OF THE INVENTION

The present invention relates generally to beach blankets, more particularly, this invention relates to a beach blanket assembly which includes a beach blanket having an elevated or raised peripheral border and wherein the assembly is securely anchored to the beach surface.

Typical devices for covering a particular section of the beach for protection of a beachgoer from the adverse characteristics of contact with sand generally include towels and blankets. Principal concerns with towels and blankets that lie on the surface of the beach are that they are susceptible to accumulation of sand, and disarray by wind and human forces.

Various types of inventions have attempted to alleviate these concerns (See e.g., U.S. Pat. No. 5,018,230 and U.S. Pat. No. 270,133). More particularly, U.S. Pat. No. 4,951,333 by Kaiser et al. discloses a self-supporting beach blanket which rests on the beach surface and includes a continuous spring steel hoop attached to the peripheral edge of the blanket. Although the blanket remains fully extended, such arrangement does not solve the problem of accumulation of sand on the surface and further should wind get under the blanket, the blanket will act as a sail and be carried away by the wind.

Another example, U.S. Pat. No. 4,709,430 by Nicoll, discloses a beach blanket having a liquid filled plastic tube secured around the perimeter to provide weight and shape to the beach blanket which rests on the surface of the beach. In this arrangement, for the weight to not be unduly cumbersome requires the diameter of the tube to be relatively small, thus affording little protection from sand accumulating on the surface.

A further example, U.S. Pat. No. 3,935,653 by Klein, describes a beach blanket staking device whereby four such devices are secured to the beach surface. Clothespins on the stakes are attached to opposite upturned edges of a beach blanket. Again the problem of accumulation of sand is encountered as well as the ease in which the blanket can be detached from the clothespins.

SUMMARY OF THE INVENTION

Accordingly, it is an object of the present invention to provide an improved beach blanket that enables beachgoers to more fully enjoy sunbathing by reducing the amount of sand that accumulates on the top surface of the beach blanket.

It is also an object of the present invention to provide such a beach blanket which is securely anchored to the beach surface in its fully extended covering position and not subject to disarray by the wind or human forces, nor susceptible to being carried away by the wind.

It is a further object of the present invention to provide such a beach blanket further containing an inflatable bumper that surrounds and abuts the peripheral border of the blanket, like a baby's crib bumper, further reducing the amount of sand susceptible to accumulating on the top surface of the blanket due to action of the wind and passersby.

It is another object of the present invention to provide such a beach blanket that is easily and quickly assembled in its fully extended state by a single individual beachgoer, and is similarly easily disassembled and carried away.

It is still another object of the present invention to provide such a beach blanket that is light in weight and easily cleaned.

It is a still yet another object of the present invention to provide such a beach blanket which can be inexpensively and easily manufactured.

Certain of the foregoing and related objects are readily obtained in a beach blanket assembly which includes a beach blanket having a peripheral border supported in a raised generally upright position above the beach surface and wherein the assembly is securely anchored to the beach surface.

In a preferred embodiment of the invention, the beach blanket assembly includes a beach blanket, an inflatable beach bumper, anchoring means including a multiplicity of stakes, and attaching means for releasably attaching the peripheral border of the blanket to the stakes and/or the inflatable beach bumper. The beach blanket has a central portion and a surrounding peripheral border wherein the peripheral border is held in a supported generally upright position by the stakes and/or the inflatable beach bumper. Specifically, the multiplicity of stakes have a lower end portion which is embedded in the beach surface and an upper end portion which abuts the inflatable beach bumper. Most desirably, the upper end portion of the stakes further releasably attach to the peripheral border of the beach blanket. In addition, the peripheral border of the beach blanket and the inflatable beach bumper preferably have a multiplicity of VELCRO type hook and loop material patches which permits the peripheral border of the blanket to be releasably attachable to the inflatable bumper.

In a another embodiment of the invention, the multiplicity of stakes attach solely to the inflatable beach bumper for securing the assembly to the beach surface.

Certain of the foregoing and related objects are also obtained in a beach blanket assembly having a beach blanket, and a multiplicity of stakes which are shaped and configured to support the entire peripheral border of the beach blanket above the beach surface as well as securely anchor the beach blanket to the beach surface.

BRIEF DESCRIPTION OF THE DRAWINGS

Other objects and features of the present invention will become apparent from the detailed description considered in connection with-the accompanying drawings, which disclose several embodiments of the invention. It is to be understood that the drawings are to be used for the purpose of illustration only and not as a definition of the limits of the invention.

In the drawings, wherein similar reference characters denote similar elements throughout the several views:

FIG. 1 is a perspective view of one embodiment of the fully installed beach blanket assembly in use;

FIG. 2 is a side elevational view, in part section, of the assembly shown in FIG. 1;

FIG. 3 is a fragmentarily-illustrated perspective view of a stake and surrounding inflatable plastic bumper;

FIG. 4 is a fragmentarily-illustrated top view of the stake and inflatable beach bumper shown in FIG. 3;

FIG. 5 is a perspective view of another embodiment of the beach blanket assembly;

FIG. 6 is a side elevational view, in part section, of the assembly shown in FIG. 5;

FIG. 7 is a perspective view of a contoured beach blanket;

FIG. 8 is a perspective view of a stake and a corner of the blanket being mounted thereon;

FIG. 9 is a perspective view of a stake having locking means;

FIG. 10 is a perspective view of another embodiment of a stake;

FIG. 11 is a side elevational view of an alternative embodiment of the stake, showing the blanket being mounted thereon and, in phantom, the blanket and bumper in final mounted position;

FIG. 12 is a side elevational view of another alternative embodiment of the stake;

FIG. 13 is a side elevational view of a further embodiment of the stake;

DETAILED DESCRIPTION OF THE PREFERRED EMBODIMENTS

Figure 14:
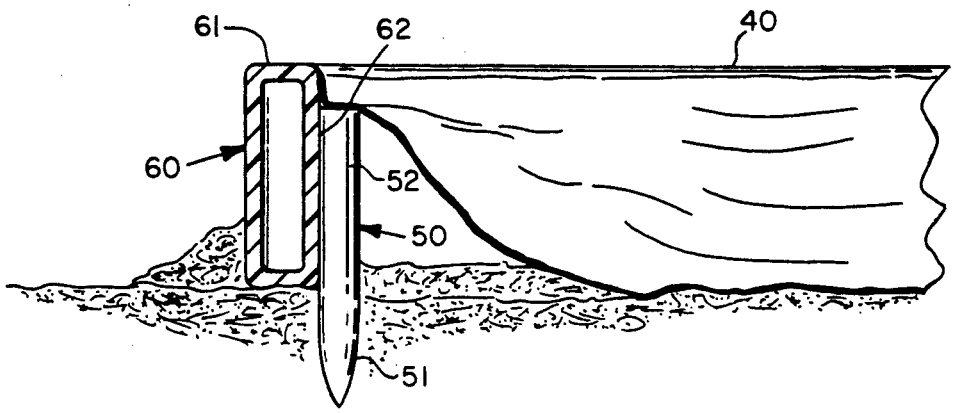
FIG. 14 is a side elevational view, in part section, of yet another embodiment of the beach blanket assembly.

Turning now in detail to the drawings, therein illustrated are several preferred embodiments of the beach blanket assemblies embodying the present invention for use on a beach surface. Referring first to FIG. 1, one version of the present beach blanket assembly includes a flexible yet sturdy sheet or beach blanket 10, a surrounding inflatable beach blanket bumper 20, anchoring means including a multiplicity of stakes 30 and attaching means for releasably attaching the peripheral border 12 of the beach blanket 10 to the inflatable beach bumper 20 and the multiplicity of stakes 30. In particular, the peripheral border 12 of the beach blanket 10 is supported in a raised generally upright position by the surrounding inflatable beach bumper 20 and the multiplicity of stakes 30.

As seen in FIG. 1, the beach blanket 10 is generally of rectangular shape (preferably 10 ft.×9 ft.) and includes a central portion 11, whereon a person sits or lies, surrounded by a peripheral border 12. Each corner 13 of the beach blanket 10, as best seen in FIG. 8, has an aperture or eyelet 14 therethrough which is shown to be circular in shape although other configurations could be employed. The corner 13 of the beach blanket 10 is strengthened by a layer of reinforcing material 15 attached to the top surface individually surrounding each eyelet 14. Additional strengthening of the corner can be accomplished by another layer of reinforcing material affixed to the bottom surface of the beach blanket 10 in conforming relation to the reinforcing material 15. Alternatively or in conjunction with the layer or layers of reinforcing material, a grommet 16 can be fitted securely around in the eyelet 15. The beach blanket 10 is preferably formed of heavy-duty khaki cotton or soft cotton terry cloth material providing a individual with a comfortable surface on which to recline and not come into contact with the sand.

With reference again to FIG. 1, the inflatable beach blanket bumper 20 is configured to surround and abut the bottom of the peripheral border 12 of the blanket 10 and support the peripheral border 12 in a raised generally upright position. The bumpers 20, as best seen in FIGS. 2 and 3, is preferably a tubular plastic shield having a hollow cross-section and a plug 21 for inflation and subsequent deflation of the shield. As seen in FIG. 3 the hollow cross-section of the plastic tubular shield is rectangular in shape having an inner sidewall 22, an outer sidewall 23, a top wall 24 and a bottom wall 25. It will be appreciated that other cross-sectional configuration could be equally employed for the plastic tubular shield. The preferred height for the inflatable beach bumper 20 in order to reduce the amount of sand accumulating on the top surface of the beach blanket 10 is approximately six (6) inches. Further, the inflatable beach bumper 20 in addition to providing support for holding the entire peripheral border 12 of the beach blanket 10 in a raised generally upright position also provides height so that the legs hang over the side of the bumper; sand can easily be brushed off—away from the blanket area.

Anchoring means for releasably anchoring the beach blanket assembly to the beach surface include a multiplicity of stakes 30. Various configurations of the stakes for use in the beach blanket assembly are shown in FIGS. 3, 4, 8, 9, 10, and 11. The stakes 30 generally have a lower end portion 31 and an upper portion 32.

Referring to FIG. 8, the lower end portion 31 of the stake 30 is structured and configured for releasably anchoring the beach blanket assembly to the beach surface. The lower end portion 31 is shown to be circular in cross-section and terminates in a tapered or pointed distal end. The upper end portion 32 extends above the beach surface being disposed inwardly and abutting the beach blanket bumper 20 and the peripheral border 12 of the beach blanket 10. As shown in FIGS. 8, 9 and 10, attached to the upper end portion 32 of the stake 30 is a radially-outwardly directed flange 33 formed on the upper end portion 31. More specifically, as best seen in FIGS. 3, 4 and 11, the flange 33 is circular in shape and is attached on the upper end portion so as to rest on the top wall 24 of the inflatable beach bumper 20. The flange 33 further provides support to the corners 13 of the beach blanket 10. The stakes 30 are preferably made from plastic or hollow aluminum for resistance to the adverse effects of salt and are of a total length of approximately twelve (12) inches long. It will be appreciated that other materials and cross-sections could equally be employed in making the stakes.

The top end of upper end portion 32 of the stakes 30 has attachment means for releasably attaching to the eyelets in the peripheral border 12 of the beach blanket 10 for supporting the peripheral border 12 in a raised generally upright position. Specifically, the top end of upper end portion 32 is circular and of a diameter less than the diameter of the eyelet 14. The top end of upper end portion 32 of the stake 30 further includes locking means for prohibiting the upper end portion 32 from disengaging from the peripheral border 12 of the beach blanket 10. As shown FIGS. 9 and 10, the top end of the upper end portion 32 is in the form of an upstanding eyelet 34. A pin 35 (FIG. 9) or clasp 36 (FIG. 10), connected and attached to a tab 37 which extends radially from the surface of the upper end portion 32 of the stake 30, is inserted through and connected around the eyelet 34. Alternatively, as shown in FIG. 11, the top end of the upper end portion 32 could include a resilient circular rubber plug 38 of a diameter slightly greater than the diameter of the eyelet 14 in the blanket 10 and which is provided with a reduced neck portion defining a radially extending channel 39. The corner 13 is placed over the rubber plug 38 in a friction fit or snap-fit manner with the eyelet 14 of the corner 31 received in channel 39.

Referring to FIGS. 3 and 7, additional attachment means for releasably attaching the peripheral border 12 to the inflatable beach bumper 20 for supporting the peripheral border 12 in a raised generally upright position include a multiplicity of hook and loop fastener patches, such as the ones sold under the trademark VELCRO®. Specifically, as best seen in FIG. 7, hook fasteners 17 are, e.g., attached in spaced apart relation to the peripheral border 12 along the bottom of the beach blanket 10. Complementary thereto, as seen in FIG. 3, corresponding loop fasteners 18 are affixed on the top wall 24 and inner sidewall 22 of the inflatable beach bumper 20, as seen in FIG. 3. Of course, the hook and loop fasteners could be reversed and the loop patches could possibly be eliminated if the beach blanket is made of a loop pile material which inherently would provide loop-type fasteners.

FIGS. 5 and 6 show another embodiment of the present beach blanket assembly. This embodiment is essentially similar to FIG. 1, except for the following points of distinctions. As shown in FIGS. 6, 13 and 14, the stake 50 has a lower end portion 51 and an upper end portion 52, wherein the upper end portion 52 terminates below the top wall 61 of the inflatable beach bumper 60. The upper end portions 52 of the stakes 50 abut and releasably attach to the inner sidewall 62 of the inflatable beach bumper. Hook fasteners 53 are attached to the upper end portion 52 of the stake 50, as best seen in FIG. 13, for corresponding engagement with loop fasteners (not shown in FIG. 14) on the inner sidewall 62. Blanket 40 is not provided with corner eyelets but instead is affixed via hook and loop fasteners (not shown) directly to the top wall 61 of bumper 60.

FIG. 12 illustrates an alternate embodiment for a stake 50' similar to stake 50, except for the fact that it is provided with a top mushroom-like cap 54 which could be used in a manner similar to stake 30 to hold down the top wall 24 of the bumper 20. However, in this case, the blanket corners would be attached to the bumper corners by additional hook and loop fasteners rather than the stakes 50'.

Figure 15:
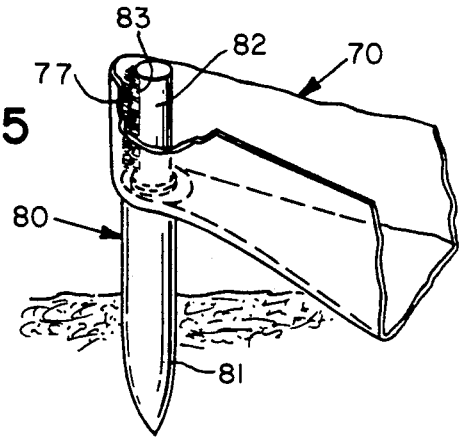
FIG. 15 is a fragmentarily-illustrated perspective view of still yet another embodiment of the beach blanket assembly.

FIG. 15 shows yet another embodiment of the present beach blanket assembly. This beach blanket assembly includes a beach blanket 70 and a multiplicity of stakes 80 which are shaped and configured to support the entire peripheral border 72 of the beach blanket 70 in a raised generally upright position above the beach surface as well as securely anchor the beach blanket 70 to the beach surface.

Figure 16:
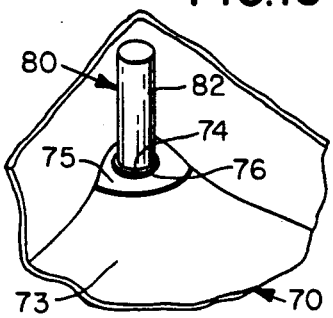
FIG. 16 is a fragmentarily-illustrated perspective view of the assembly shown in FIG. 15 at a slightly different angle of reference.
Figure 18:
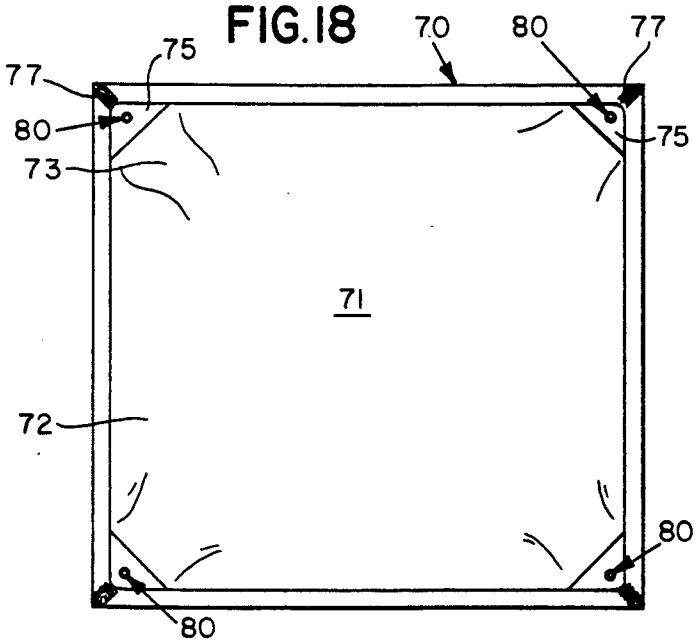
FIG. 18 is a top view of the assembly shown in FIG. 15 prior to the perimeter being held in an upward position.

Referring to FIG. 18, the beach blanket 70 is shown generally of rectangular shape and includes a central portion 71, surrounded by a peripheral border 72. Each corner 73 of the beach blanket 70, as best seen in FIG. 16, has an aperture or eyelet 74 therethrough. The corner 73 of the beach blanket 70 is strengthened by a layer of reinforcing material 75 attached to the top surface individually surrounding each eyelet 74. Alternatively or in conjunction with the layer or layers of reinforcing material, a grommet 76 can be fitted securely around the eyelet 74.

Figure 17:
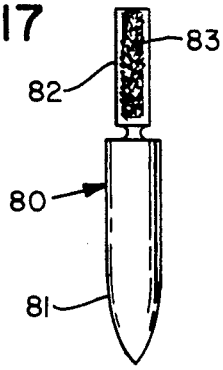
FIG. 17 is a side elevational view of another alternative embodiment of the stake.

Referring now to FIG. 17, the upper end portion 82 and the lower end portion 81 of stake 80 are of differing cross-sectional diameters. Specifically the lower end portion 81 is of a greater diameter than the eyelet 74 in the beach blanket 70 and the upper end 82 is of a diameter sized to pass through and extend above the eyelet 74. The corner 73 of the beach blanket 70 surrounding the eyelet 74 rests on the lower end portion 81 which acts as a stop. The stake 80 further contains hook fasteners 83 attached to the upper end portion 82, as best seen in FIG. 17, for corresponding engagement with loop fasteners 77 on the peripheral corner of the beach blanket 70, so that the peripheral border 72 is held in a generally upright position. Other releasable attachments other than hook and loop fasteners such as draw strings, elastic loops, etc. can also be used for securing the blanket to the stakes.

Thus, while only several embodiments of the present invention have been shown and described, it is obvious that many changes and modification may be made thereunto without departing from the spirit and scope of the invention.

What is claimed is:

1. A beach blanket assembly having a raised border for use on a beach surface, comprising:

a beach blanket having a central portion surrounded by a peripheral border, said peripheral border being supportable in a raised generally upright position;

an inflatable beach blanket bumper surrounding and abutting said blanket peripheral border when said border is in said raised upright position thereof;

anchor means for releasably anchoring said assembly to the beach surface, said anchor means including a multiplicity of stakes having upper and lower end portions, said lower end portions of which are intended for embedment below the beach surface of said upper end portions of which are intended to be disposed above the beach surface so as to abut and support at least one of said beach blanket peripheral border and said beach blanket bumper, said stakes being disposed inwardly of said bumper; and releasable attachment means for releasably attaching said peripheral border of said blanket to at least one of said anchor means and said beach blanket bumper so as to support the same in a raised generally upright position.

2. The beach blanket assembly according to claim 1, wherein said releasable attachment means comprise a multiplicity of hook and loop fasteners, one of which is secured to the peripheral border of said blanket and the other of which is secured to at least one of said anchor means and said bumper.

3. The beach blanket assembly according to claim 1, wherein said releasable attachment means comprise a multiplicity of eyelets provided in said peripheral border of said blanket which are dimensioned to be received on the upper end portions of said stakes.

4. The beach blanket assembly according to claim 3, wherein said stakes further includes a radially-outwardly directed flange formed on said upper end portion.

5. The beach blanket assembly according to claim 4, wherein said upper end portions further includes locking means to prevent the disengagement of said eyelets from said upper end portions.

6. The beach blanket assembly according to claim 5, wherein said blanket is of substantially rectangular shape having one of said eyelets in each corner thereof.

7. The beach blanket assembly according to claim 1, wherein said inflatable bumper comprises a plastic tubular shield having a hollow cross-section, and a plug for inflation and deflation.

8. The beach blanket assembly according to claim 7, wherein said inflatable plastic shield is of generally rectangular cross-section.

9. A beach blanket assembly having a raised border for use on a beach surface, comprising:

a beach blanket having a central portion surrounded by a peripheral border and a multiplicity of eyelets provided in said peripheral border, said peripheral border further being supportable in a raised generally upright position;

a multiplicity of stakes having upper and lower end portions, said lower end portions of which are intended for embedment below the beach surface and said upper end portions which are intended to be disposed above the beach surface and dimensioned to be insertable through said eyelets of said peripheral border so as to support said peripheral border when said border is in said raised upright position; and releasable attachment means for releasably attaching said peripheral border adjacent said eyelets to said upper portion of said stake so as to support said border in a raised generally upright position, said releasable attachment means including a multiplicity of hook and loop fasteners, one of which is secured to the peripheral border of said blanket adjacent said eyelet and the other of which is secured to said upper end portion of said stake.

10. The beach blanket assembly according to claim 9, further including a plurality of reinforcing materials attached to said blanket in surrounding relationship to each of said eyelets.

11. The beach blanket assembly according to claim 10, further including a grommet secured to each eyelet.

* * * * *